United States Patent [19]

Hilt et al.

[11] Patent Number: 5,001,896

[45] Date of Patent: Mar. 26, 1991

[54] IMPINGEMENT COOLED CROSSFIRE TUBE ASSEMBLY IN MULTIPLE-COMBUSTOR GAS TURBINE ENGINE

[76] Inventors: Milton B. Hilt, R.D. 1, Sloansville, N.Y. 12160; Lewis B. Davis, Jr., 24 Ray St., Schenectady, both of N.Y. 12309

[21] Appl. No.: 834,073

[22] Filed: Feb. 26, 1986

[51] Int. Cl.[5] ..... F02G 1/00

[52] U.S. Cl. ..... 60/39.32; 60/39.821

[58] Field of Search ..... 60/39.31, 39.32, 39.37, 60/39.821, 39.826

[56] References Cited

U.S. PATENT DOCUMENTS

| | | | |
|---|---|---|---|
| 2,611,243 | 9/1952 | Huyton | 60/39.32 |
| 3,811,274 | 5/1974 | Calderon | 60/39.32 |
| 3,991,560 | 11/1976 | DeCorso et al. | 60/39.32 |
| 4,249,372 | 2/1981 | White | 60/39.32 |

*Primary Examiner*—Louis J. Casaregola
*Assistant Examiner*—T. S. Thorpe

[57] ABSTRACT

A crossfire tube assembly joining adjacent combustors in a gas turbine engine includes an impingement sleeve within which a crossfire tube is centrally disposed. The impingement sleeve is pierced by an array of impingement cooling holes which form a plurality of small jets of cooling air impinging upon, and cooling, the crossfire tube. The space between the impingement sleeve and the crossfire tube forms a flow channel along which the spent impingement air flows in the axial direction before exiting into the interiors of the combustors. A flow dam at the center of the flow channel forces the impingement air to flow toward the ends. An outward flare in a portions of the crossfire tube extending beyond the extremity of the impingement sleeve directs air exiting the flow channel upon an annular flange which supports the crossflow assembly and thus improves cooling in this area.

4 Claims, 2 Drawing Sheets

IMPINGEMENT COOLED CROSSFIRE TUBE ASSEMBLY IN MULTIPLE-COMBUSTOR GAS TURBINE ENGINE

BACKGROUND OF THE INVENTION

The present invention relates to gas turbine engines and, more particularly, to gas turbine engines of the type employing a plurality of combustors for burning fuel with air to produce hot, energetic gasses for impingement upon the blades or buckets of a turbine.

A large gas turbine engine conventionally includes a plurality of combustors within each of which a fuel is reacted with a supply of compressed air to produce a plentiful supply of hot gasses. The hot gasses flow at high speed from the combustors to impinge upon the blades or buckets of a rotatable turbine wheel. The turbine wheel rotates an output shaft and also drives a compressor for producing the supply of compressed air. In some gas turbine engines, for example, aircraft jet engines, the output shaft is omitted. The output of the gas turbine is obtained as an exhaust flow which directly propels the aircraft on which it is located.

The combustors are conventionally disposed in a circle about a perimeter of the gas turbine engine. The combustion reaction zones of all adjacent combustors are joined by crossfire, or crossover, tubes which are essentially open tubular structures through which gas and flame are capable of flowing under the influence of a pressure difference in the combustors to which they are connected.

During startup, the shaft of the gas turbine engine is cranked to starting speed by an external energy source. Then, fuel and air are introduced to all of the combustors. A spark plug in one or two of the combustors is fired to start the combustion reaction. As the combustion reaction begins in a combustor, the pressure therein rises due to the production of hot gas. If a neighboring combustor is unlit, the pressure differential produced by the higher pressure in the lit combustor forces hot gas and flame to flow into the unlit combustor. In this way, each adjacent combustor is lit beginning with the lighting of only one or two combustors.

In theory, once all combustors are lit, their pressures equalize and the flow of gas and flame through the crossfire tubes should stop. In practical gas turbine engines, however, differences in geometry, air flow and fuel metering between adjacent combustors may promote continuous gas and flame flow through the crossfire tube joining them. A small amount of flow through the crossfire tubes aids in balancing the pressures and flows from the combustors. The crossfire tubes are connected to the hottest areas of the combustors wherein temperature of, for example, more than 3000 degrees F. may exist. Although the flow of gas and flame through the crossfire tubes does not affect the operation of the gas turbine engine, if a large pressure difference develops between combustors the high gas and flame temperatures flowing through the crossfire tubes are capable of their rapid destruction.

One method for discouraging continuous gas flow in crossfire tubes employs vent holes through the crossfire tubes. Pressurized air in the plenum surrounding the combustors and crossfire tubes flows inward through the vent holes and both cools any gas flowing in the crossfire tubes and tends to equalize the pressure differential along the length thereof. The reduced pressure differential may preclude crossfire gas flow below a given pressure differential. In addition, the air flowing through the vent holes tends to cool the crossfire tube walls to reduce the temperature thereof.

Although they equalize the pressure differential between the ends of the crossfire tube, the vent holes interfere with the primary function of the crossfire tubes in flame propagation. It is thus desirable either to eliminate the vent holes in the crossfire tubes or to limit the amount of vent air capable of flowing therethrough.

Each end of a crossfire tube is affixed in the wall of its combustor using an inward-directed flange. Such flanges tend to become hot and a method for cooling them is desirable.

OBJECTS AND SUMMARY OF THE INVENTION

It is an object of the invention to provide means for controlling the temperature of a crossfire tube in a gas turbine engine which overcomes the drawbacks of the prior art.

It is a further object of the invention to provide means for cooling the walls of a crossfire tube in a gas turbine engine.

It is a still further object of the invention to provide means for impingement cooling of an exterior surface of a crossfire tube in a gas turbine engine. The impingement cooling means includes means for forcing the impingement air to flow axially outward from the center of the crossfire tube toward its ends.

It is a still further object of the invention to provide an impingement cooling apparatus for cooling a crossfire tube in a gas turbine in which a flow channel is created between an impingement sleeve and the crossfire tube. The impingement sleeve is affixed into the walls of adjacent combustors and the spent impingement air flowing in the flow channel is exhausted into the combustors. The outer ends of the crossfire tube are flared radially outward to direct the outflowing impingement air toward a lip surrounding each end of the impingement tube which secures the impingement sleeve into the wall of the combustor.

Briefly stated, the present invention provides a crossfire tube assembly joining adjacent combustors in a gas turbine engine which includes an impingement sleeve within which a crossfire tube is centrally disposed. The impingement sleeve is pierced by an array of impingement cooling holes which form a plurality of small jets of cooling air impinging upon, and cooling, the crossfire tube. The space between the impingement sleeve and the crossfire tube forms a flow channel along which the spent impingement air flows in the axial direction before exiting into the interiors of the combustors. A flow dam at the center of the flow channel forces the impingement air to flow toward its ends. An outward flare in portions of the crossfire tube extending beyond the extremity of the impingement sleeve directs air exiting the flow channel upon an annular flange which supports the crossflow assembly and thus improves cooling in this area.

According to an embodiment of the invention, there is provided a crossfire tube assembly for propagating flame between first and second combustors comprising an impingement sleeve having first and second ends, means for affixing the first end in the first combustor, means for affixing the second end in the second combustor, a crossfire tube centrally disposed within the impingement sleeve, a flow channel between the crossfire tube and the impingement sleeve, a plurality of impingement cooling holes in the impingement sleeve, the plurality impingement cooling holes being effective for forming a plurality of jets of air which impinge upon, and cool, the crossfire tube, a flow dam centrally disposed in the flow channel, the flow dam being effective for substantially preventing flow of air therepast, and means for permitting an exit of impingement air from the flow channel into the first and second combustors.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
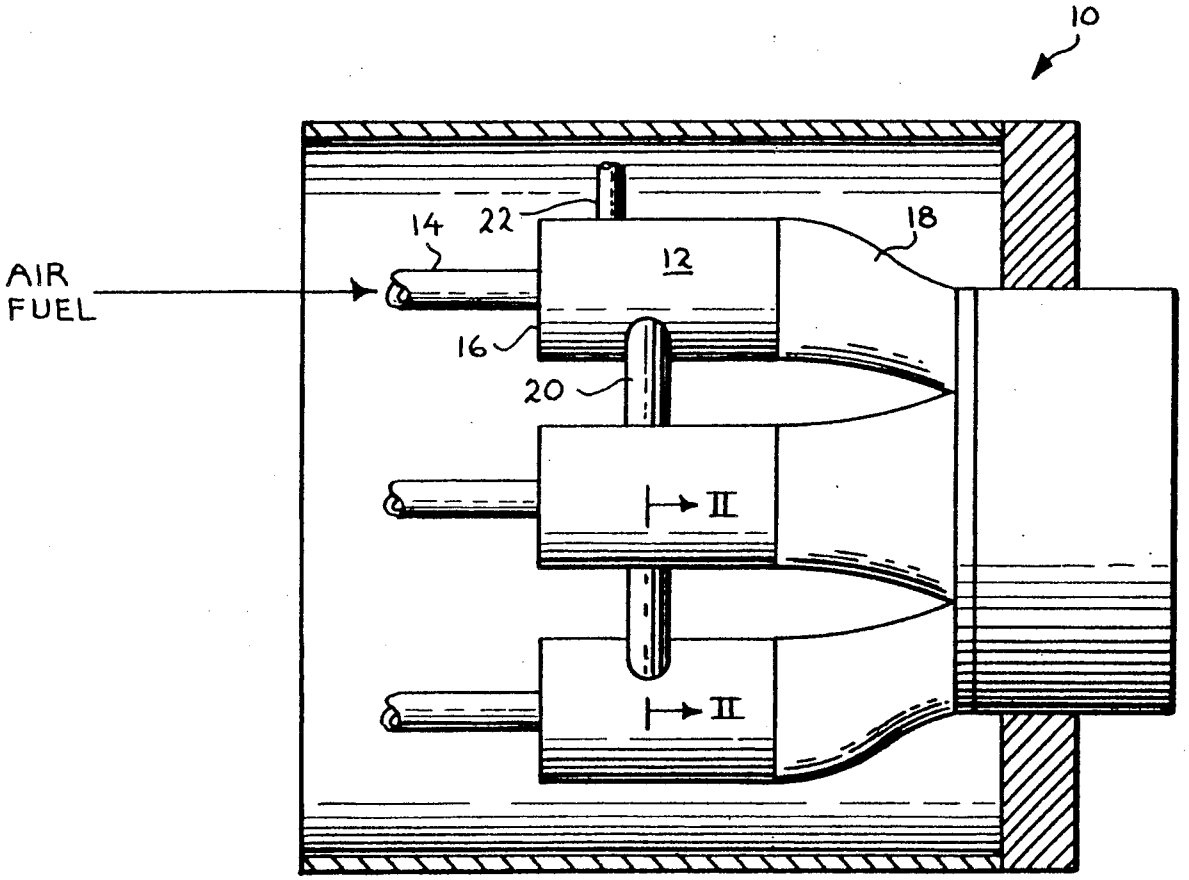
FIG. 1 is a side view, partly cut away, of several combustors in a circular array in a gas turbine engine.

Referring to FIG. 1, a circular or annular combustor array, a part of which is shown generally at 10, includes a plurality of combustors 12 spaced at equal angles about an axis of the gas turbine engine with which they are associated. Each combustor 12 conventionally is cylindrical in shape, and receives a supply of fuel and atomizing air at a fuel fitting 14 in a closed end 16 thereof. Combustor 12 is surrounded by a plenum (15) containing pressurized air. Combustion, cooling and dilution air flows from the plenum through openings (not shown) in the walls of each combustor 12 to support the combustion reaction therewithin.

Due to its cylindrical shape, the flow field of the hot gasses flowing from each combustor 12 has a generally circular cross section. A transition piece 18, at the end of each combustor 12, changes the cross section of the flow field of the gasses into a sector of an annulus. The transition pieces 18 are disposed with the extremities of each annular sector closely abutting the ends of the annular sectors of its neighbors. Thus, the combined output of combustor array 10 is a close approximation of a full annulus which then passes into the turbine section (not shown) of the gas turbine.

A crossfire tube 20 joins the region of each adjacent pair of combustors 12 within which the combustion reaction takes place.

A spark plug 22 in at least one of combustors 12 provides primary ignition of the fuel-air mixture therein. The increased pressure in the combustor 12 having spark plug 22 provides a pressure differential between itself and its two neighboring combustors 12 sufficient to urge hot gas and flame through the crossfire tubes 20 thereby igniting the fuel-air mixture in adjacent combustors 12. In this manner, the combustion propagates to all combustors 12. Once combustion is achieved in all combustors 12, crossfire tubes 20 serve no additional purpose until the next startup sequence is performed. However, sufficient pressure differentials may exist in adjacent combustors 12 to produce a continuous flow of gas and flame through one or more of combustors 12 under load.

Each spark plug 22 requires the expense of an exciter and control system, in addition to other equipment. It therefore is desirable to employ a minimum number of spark plugs 22 for igniting all of combustors 12. In practice, an improvement in reliability is achieved by using more than one spark plug 22. The resulting redundancy permits satisfactory starting, even in the event of failure of a critical component in any one spark plug 22 or its associated equipment. In the preferred embodiment, two spark plugs 22 (only one of which is shown) are disposed in separate combustors 12 with all adjacent combustors 12 connected by crossfire tubes 20.

Figure 2:
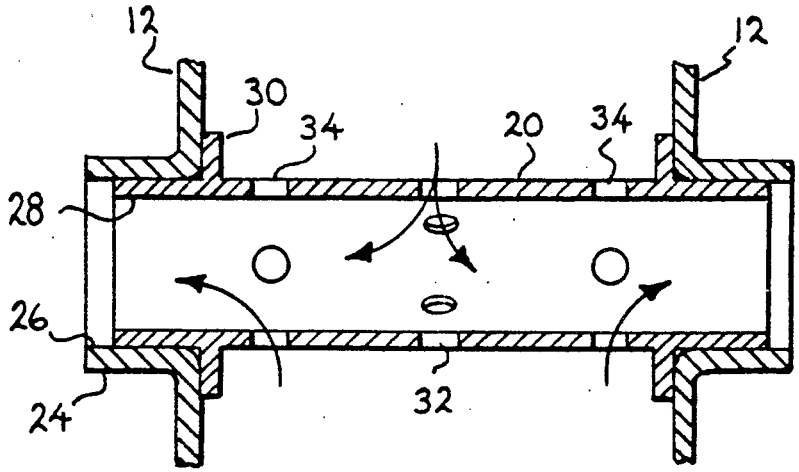
PRIOR ART FIG. 2
FIG. 2 is a cross section taken along II—II in FIG. 1.

Referring now to FIG. 2, a crossfire tube 20, according to the prior art, is shown together with its connection to adjacent combustors 12. An outward-directed annular flange 24 provides an opening 26 into which an end 28 of crossfire tube 20 is inserted. Annular flange 24 provides sufficient surface contact area between opening 26 and end 28 for secure assembly thereof. A positioning flange 30 encircles the outer surface of crossfire tube 20 at each end thereof. Crossfire tube 20 is located by a retainer 31 adjacent to each combustor 12. Each retainer 31 bears against its respective positioning flange 30 for maintaining crossfire tube 20 in the proper position.

A row of center vent holes 32 pierce crossfire tube 20. Two rows of end vent holes 34, one at either end, pierce crossfire tube 20 near positioning flange 30. Both the number and size of center vent holes 32 and end vent holes 34 may be varied as necessary to attain suitable crossfire reduction under load while interfering as little as possible with the necessary crossfire during startup. In one embodiment of the prior art, the row of center vent holes 32 consists of six, quarter-inch holes, and each row of end vent holes 34 consists of four, quarter-inch holes.

In operation, if the pressure in the combustor 12 at the right of the drawing exceeds the pressure in the one at the left, hot gas and flame tends to move through crossfire tube 20 from right to left. Since both combustors 12 and their crossfire tube 20 are contained in a plenum having an air pressure which exceeds the highest pressure within either combustor 12, compressed air tends to flow inward through center vent holes 32 and end vent holes 34 thus suppressing this movement toward the left. The air flow is indicated by arrows.

The air flowing into crossfire tube 20 performs two functions. First, it tends to equalize the pressure between the two ends of crossfire tube 20, thus resisting the flow of gas and flame from right to left in the figure. Second, if the pressure differential is too great to prevent crossfire, the flow of air tempers the gas and flame flowing through crossfire tube 20, thus reducing the temperature reached by the wall of crossfire tube 20. Both of these effects are antagonistic to the primary function of crossfire tubes 20; that is, to permit the free flow of hot gas and flame during startup.

Figure 3:
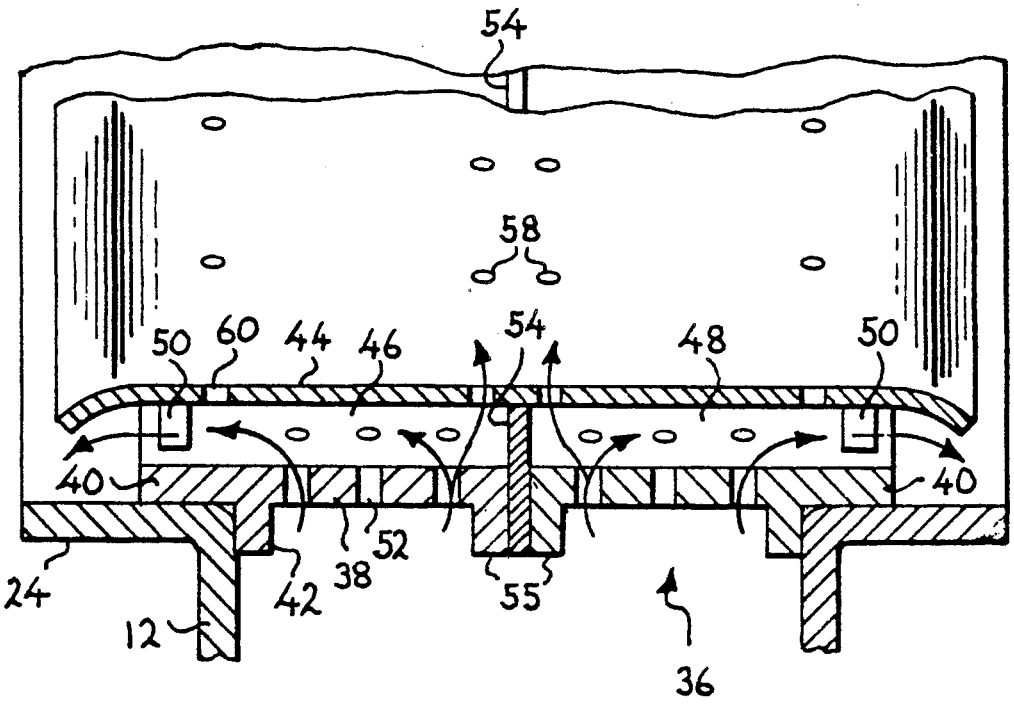
FIG. 3 is an enlarged cross section of a portion of a crossfire tube assembly according to an embodiment of the invention.

Referring now to FIG. 3, there is shown, generally at 36, a crossfire tube assembly according to an embodiment of the invention. An impingement sleeve 38 includes ends 40 which fit into openings 26 formed by outward-directed annular flanges 24 in their respective combustors 12. A positioning flange 42 and a retainer 43 at each end of impingement sleeve 38 serve the same function as positioning flange 30 and retainer 31 perform in the prior-art embodiment of FIG. 2. A crossfire tube 44 is positioned centrally within impingement sleeve 38 with left and right flow channels 46 and 48 therebetween. A plurality of positioning devices 50 of any convenient type such as, for example, spacer blocks, are spaced apart near the ends of left and right flow channels 46 and 48 to maintain crossfire tube 44 centered in impingement sleeve 38.

A plurality of impingement cooling holes 52 pierce impingement sleeve 38, thereby permitting jets of cooling air to impinge upon the outer surface of crossfire tube 44, and limiting the maximum temperature of crossfire tube 44. A flow dam 54, affixed to the center of the outer surface of crossfire tube 44, bridges the space between impingement sleeve 38 and crossfire tube 44 and is clamped between flanges 55. Flow dam 54, maintains crossfire tube 44 axially centered in impingement sleeve 38, and prevents air from flowing between left and right flow channels 46 and 48. Thus, most of the air flowing through impingement cooling holes 52 into left flow channel 46 is forced to flow axially to the left, as indicated by arrows, into the interior of combustor 12. Similarly, most of the air flowing through impingement cooling holes 52 into right flow channel 48 is forced to flow axially to the right into the interior of combustor 12.

An outward flare 56 at each end of crossfire tube 44 extends beyond ends 40 of impingement sleeve 38. Outward flares 56 direct the flow of air exiting left flow channel 46 and right flow channel 48 onto openings 26 for cooling annular flange 24 before entering combustors 12. This cooling air alleviates a problem of excessive temperature in annular flange 24.

Although some applications may permit the elimination of vent holes through crossfire tube 44, others may benefit from a small number of such vent holes. Two rows of vent holes 58 may be disposed in left and right flow channels 46 and 48 near flow dam 54. Such positioning of vent holes 58, besides performing the venting function discussed in connection with the prior art, also provides an exit for some of the impingement air in left and right flow channels 46 and 48. This encourages some of the impingement air to flow toward the center of crossfire tube 44, thereby improving the cooling in this generally critical location.

Since the task of cooling crossfire tube 44 is performed by impingement air, vent holes 58 may be smaller and spaced further apart than is possible in the prior art. Thus, vent holes 58 are less likely to interfere with the necessary crossfire function of crossfire tube assembly 36.

Other vent holes may be included in crossfire tube 44 as necessary. For example, a row of end vent holes 60 may be disposed near the ends of crossfire tube 44. End vent holes 60 may be smaller and spaced further apart than is possible in crossfire tube 20 (FIG. 2) of the prior art.

Impingement cooling holes 52 may have equal sizes and be spaced evenly over impingement sleeve 38. The hole size and/or spacing of impingement cooling holes 52 may be varied, as necessary, to direct a greater quantity of impingement air onto critical regions of crossfire tube 44. In addition, impingement cooling holes 52 may have their axes radially disposed as shown, or inclined as necessary for directing the impingement air in desired directions. The inclination of the axes of impingement cooling holes 52 may be axial or tangential, or both.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A crossfire tube assembly for propagating a flame between two adjacent gas turbine combustors comprising:

an impingement sleeve comprising a cylinder open at each end for attachment to a combustor; a plurality of impingement cooling holes in the impingement sleeve, the impingement holes spaced apart from each other in the axial and circumferential direction along the axial length of the impingement sleeve;

a crossfire tube concentrically disposed within the impingement sleeve and open at each end;

an annular flow channel formed between the impingement sleeve and the crossfire tube;

an annular flow dam extending between the impingement sleeve and the flow channel and located approximately equidistant from the two ends of the impingement sleeve and the crossfire tube;

vent holes in the crossfire tube located on each side of the annular flow dam proximate to the annular flow dam in the center of the crossfire tube assembly whereby impingement air on one side of the flow dam is directed to one set of vent holes on the same side of the flow dam; and, impingement air on the other side of the flow dam is directed to another set of vent holes located on the other side of the flow dam.

2. A crossfire tube assembly in accordance with claim 1 further comprising an outwardly flared portion at each end of the crossfire tube for directing impingement air in the annular flow channel across the end of the impingement sleeve in each respective outward axial direction away from the annular flow dam.

3. A crossfire tube assembly for propagating flame between first and second combustors, comprising:

an impingement sleeve having first and second ends;

means including an annular flange in said first combustor receiving a first end of said impingement sleeve for affixing said first end in said first combustor;

means for affixing said second end in said second combustor;

a crossfire tube centrally disposed within said impingement sleeve;

a flow channel between said crossfire tube and said impingement sleeve;

a plurality of impingement cooling holes in said impingement sleeve, said plurality of impingement cooling holes forming a plurality of jets of air which impinge upon, and cool, said crossfire tube;

a flow dam centrally disposed in said flow channel, said flow dam for substantially preventing flow of air therepast; and, means for permitting an exit of impingement air from said flow channel into said first and second combustors; and wherein said crossfire tube includes an outward flare in a portion thereof extending beyond an end of said impingement sleeve, said outward flare directing impingement air exiting said flow channel outward toward said annular flange.

4. A crossfire tube assembly for propagating flame between first and second combustors, comprising:

an impingement sleeve having first and second ends;

means for affixing said first end in said first combustor;

means for affixing said second end in said second combustor;

a crossfire tube centrally disposed within said impingement sleeve;

a flow channel between said crossfire tube and said impingement sleeve;

a plurality of impingement cooling holes in said impingement sleeve, said plurality of impingement cooling holes forming a plurality of jets of air which impinge upon, and cool, said crossfire tube;

a flow dam centrally disposed in said flow channel, said flow dam for substantially preventing flow of air therepast; and, means for permitting an exit of impingement air from said flow channel into said first and second combustors; and wherein said crossfire tube includes at least first and second vent holes, said first vent hole being disposed close to a first side of said flow dam, whereby a first air flow is urged to flow in said flow channel toward a center of said crossfire tube, and said second vent hole being disposed close to a second side of said flow dam, whereby second flow is urged to flow in said flow channel toward said center of said crossfire tube.

* * * * *